US007352265B2

(12) United States Patent
Opfer et al.

(10) Patent No.: US 7,352,265 B2
(45) Date of Patent: Apr. 1, 2008

(54) MANUAL TRIP CONTROL METHOD AND ARRANGEMENT FOR MULTIPLE CIRCUIT INTERRUPTERS

(75) Inventors: John C. Opfer, Chicago, IL (US); Christopher R. Lettow, Buffalo Grove, IL (US)

(73) Assignee: S & C Electric Co., Chicago, IL (US)

( * ) Notice: Subject to any disclaimer, the term of this patent is extended or adjusted under 35 U.S.C. 154(b) by 303 days.

(21) Appl. No.: 11/304,828

(22) Filed: Dec. 16, 2005

(65) Prior Publication Data

US 2006/0197639 A1 Sep. 7, 2006

Related U.S. Application Data

(60) Provisional application No. 60/638,749, filed on Dec. 27, 2004.

(51) Int. Cl.
*H01H 75/00* (2006.01)

(52) U.S. Cl. ..... 335/6; 335/10; 335/11; 335/21; 335/22; 335/38; 335/173; 335/174; 361/114

(58) Field of Classification Search ..... 335/6, 335/8–11, 21, 22, 35, 38, 172, 173, 174; 361/114, 115, 160
See application file for complete search history.

(56) References Cited

U.S. PATENT DOCUMENTS 2,752,535 A * 6/1956 Fountain ..... 361/63
4,754,162 A * 6/1988 Kondou et al. ..... 307/112

* cited by examiner

*Primary Examiner*—Ramon M. Barrera
(74) *Attorney, Agent, or Firm*—James V. Lapacek

(57) ABSTRACT

A manual trip control method and arrangement is provided to manually trip a plurality of circuit interrupters. Specifically, where the circuit interrupters include magnetic-actuator-driven vacuum interrupters including permanent magnets that hold the contacts of the circuit interrupter in the closed position via a plunger, a first of the circuit interrupters is manually tripped via movement of the plunger. To operate the remaining circuit interrupters to trip open, the voltage generated in the magnetic actuator of the first circuit interrupter is coupled to the magnetic actuators of the remaining circuit interrupters for tripping thereof.

3 Claims, 2 Drawing Sheets

MANUAL TRIP CONTROL METHOD AND ARRANGEMENT FOR MULTIPLE CIRCUIT INTERRUPTERS

This application claims the benefit of U.S. Provisional Application No. 60/638,749 filed on Dec. 27, 2004.

BACKGROUND OF THE INVENTION

1. Field of the Invention

The present invention relates generally to the field of protective devices and systems for electrical power transmission and distribution systems, and more particularly to a manual trip control method and arrangement to manually trip a plurality of circuit interrupters.

2. Description of the Related Art

Various circuit interrupters and control arrangements are known in the prior art. For example, typical circuit reclosers for the electric power distribution field include magnetic-actuator-driven vacuum interrupters. While these circuit reclosers are provided for each phase of a multi-phase electrical system, the magnetic actuators are utilized to trip and reclose on single-phase fault conditions without affecting the other unfaulted phases. However, there are situations when it is desirable to trip all the poles for the phases and the recloser controls locked out so as to prevent the reclosers from closing. For example, when performing maintenance, it is desirable to manually trip all the phases. Also, whenever the reclosers are manually tripped, it is desirable to accomplish the tripping within a short period of time, e,g, less than two seconds, to prevent single-phasing any multi-phase motor loads. Typical recloser installations often use individual pole units and do not have common base and mounting structure that might allow for ganged manual tripping. Accordingly, individual manual trip handles on each of the reclosers must be operated such that it is not possible to trip all the poles within any short period of time. Since the reclosers must be operated from the ground with a long flexible pole, the time between the tripping of the individual pole units can be many seconds.

While the prior art arrangements may be generally useful, these prior arrangements do not provide desirable manual tripping of a plurality of reclosers.

SUMMARY OF THE INVENTION

Accordingly, it is a principal object of the present invention to provide a manual trip control method and arrangement to manually trip a plurality of circuit interrupters without the need for any mechanical operating linkage between the reclosers or a source of electrical tripping energy while also maintaining non-simultaneity to less than one cycle of the electrical source.

It is another object of the present invention to provide a manual trip control arrangement to manually trip a plurality of circuit interrupters via manually tripping a first of the circuit interrupters and the voltage generated during the tripping being utilized to trip the remaining circuit interrupters.

These and other objects of the present invention are efficiently achieved by the provision of a manual trip control method and arrangement to manually trip a plurality of circuit interrupters. Specifically, where the circuit interrupters include magnetic-actuator-driven vacuum interrupters including permanent magnets that hold the contacts of the circuit interrupter in the closed position via a plunger, a first of the circuit interrupters is manually tripped via movement of the plunger. To operate the remaining circuit interrupters to trip open, the voltage generated in the magnetic actuator of the first circuit interrupter is coupled to the magnetic actuators of the remaining circuit interrupters for tripping thereof.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
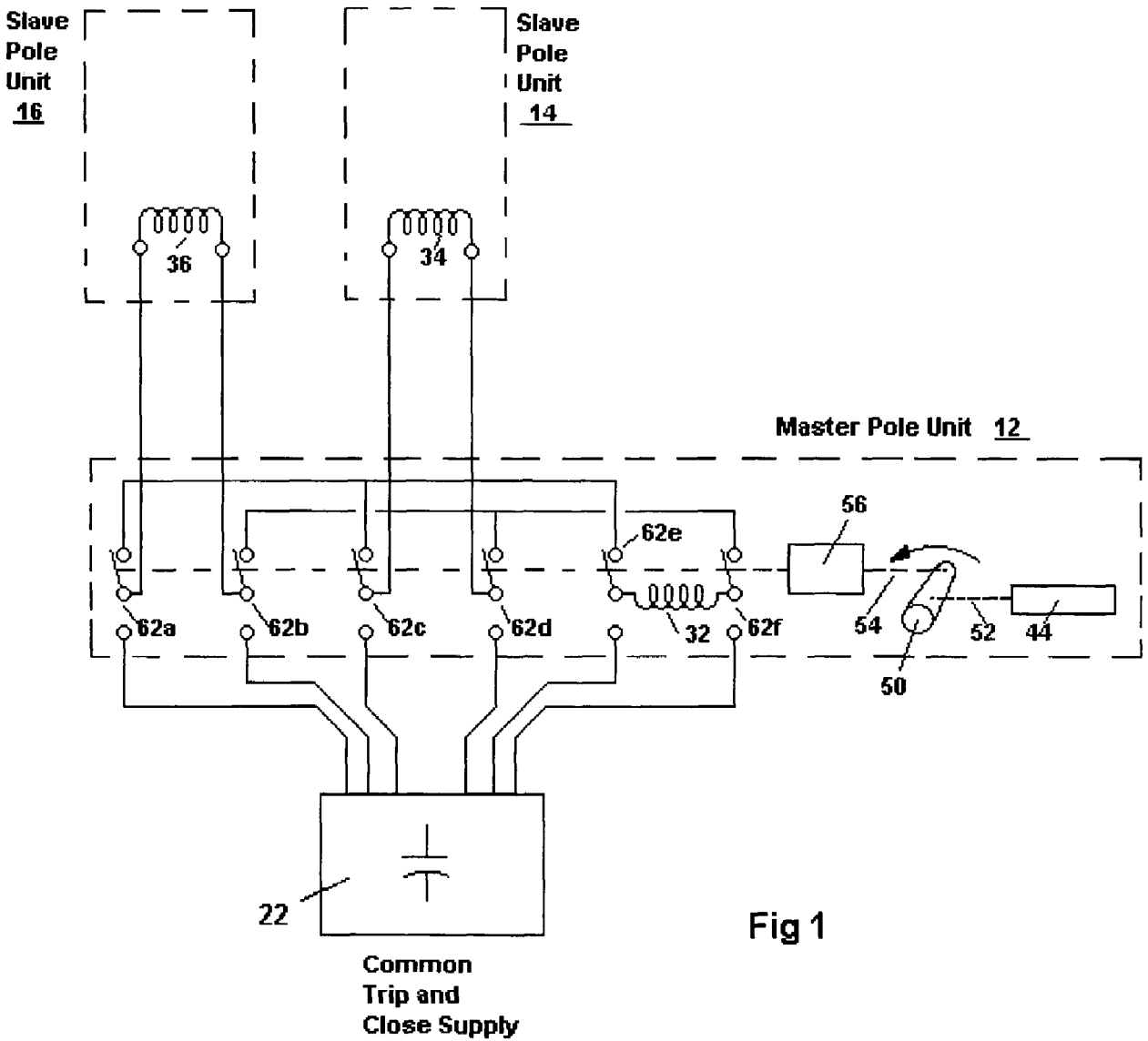
FIG. 1 is a diagrammatic representation of a manual trip control arrangement in accordance with the present invention.

Referring now to FIG. 1, a manual trip control arrangement 10 of the present invention is adapted to interact with and control the actuator circuits of circuit interrupters that include magnetic-actuator-driven interrupters including permanent magnets that hold the contacts of the circuit interrupter in the closed position via a plunger. In the illustrative arrangement of FIG. 1, portions of the control circuits of three reclosers 12, 14, 16 are shown. The control circuit of a designated master pole unit 12 of the reclosers includes a common trip and close supply 22 that is connected to control magnetic actuator coils 32, 34, 36 for the respective reclosers, the control circuits of the other two circuit interrupters 14, 16 functioning as slave pole units.

Figure 2:
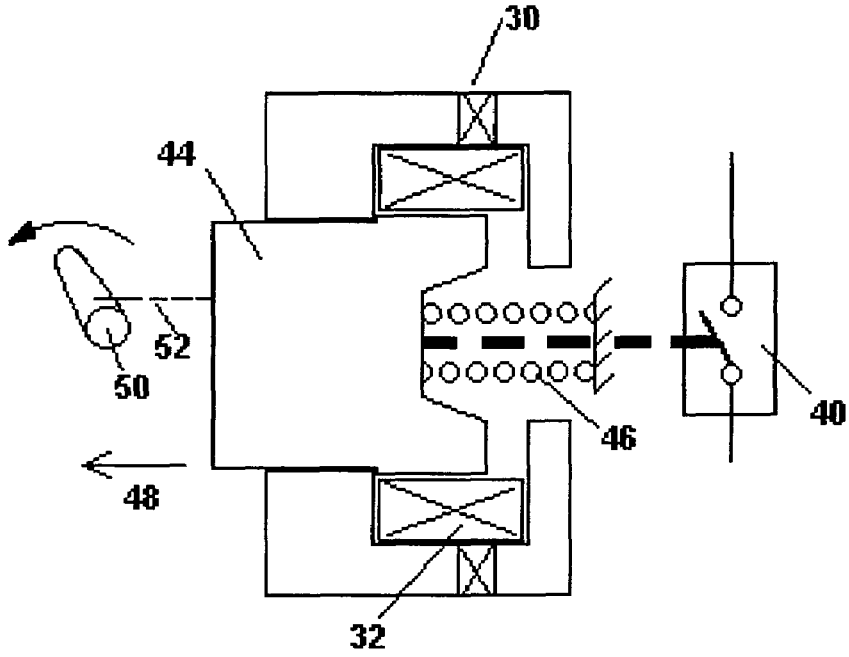
FIGS. 2 and 3 are diagrammatic representations of portions of the control features of typical circuit interrupter for use with the manual trip control arrangement of FIG. 1 illustrating respective opened and closed operating positions.
Figure 3:
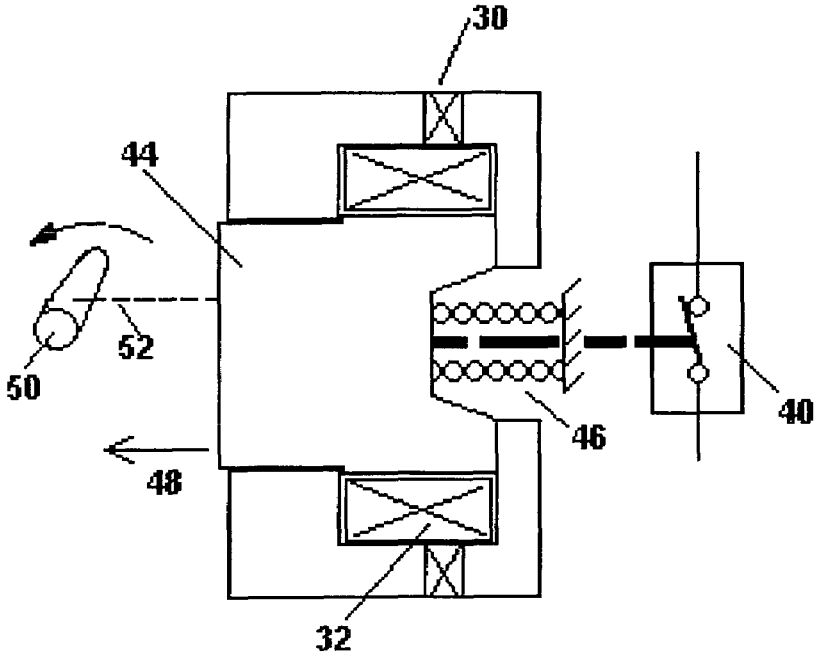

With additional reference now to FIGS. 2 and 3, in typical recloser control circuits of this type, a permanent magnet 30 is utilized to hold the contacts 40 of the recloser closed. Reclosers of this type typically utilize a permanent magnet 30, e.g. Alnico, having a low coercive force such that a low tripping energy results for the magnetic actuator. When tripping is required, the coils 32, 34 36 are pulsed by the common trip and close supply 22 so as to momentarily reduce the flux in the magnetic circuit of the recloser control, e.g. in the magnetic circuit including the permanent magnet 30 and a moving plunger 44. An opening spring 46 is provided that biases the contacts 40 toward an opened position. When the magnetic flux is reduced by the coil 32, the opening spring 46 overcomes the tractive force in the magnetic circuit and the contacts 40 are opened via movement of the plunger 44 in the opening direction.

In accordance with important aspects of the present invention, another way to open a recloser of this type is to apply a force to the plunger 44 in the opening direction 48 of sufficient magnitude to overcome the tractive force in the magnetic circuit. For example, as shown in FIGS. 2 and 3, a manual trip handle 50 is arranged to move the plunger 44 via interconnection 52 in the opening direction. Once the gap in the magnetic circuit is sufficiently large, the opening spring 46 will propel the plunger 44 to open and open the contacts 40 to accomplish circuit interruption, i.e. at the same desirable speed of operation as result from a pulsing of the coil 32. As a result of this manual tripping, a voltage is generated in the coil 32 due to the rapid change in magnetic flux as the plunger 44 moves. To this end, the manual trip control arrangement 10 provides for the selective connection of the coils 32, 34, 36 in parallel with each other. Thus, the voltage generated in the coil 32 by the manual tripping of the contacts 40 of a first of the reclosers 12 provides a tripping pulse to each of the coils 34 and 36 thus tripping open those respective reclosers 14, 16.

In the specific arrangement as shown in FIG. 1, the manual trip handle 50 is arranged via interconnection 54 to operate a selector switch 56, the selector switch 56 including controlled double-pole, double throw contact sets 62*a,b*, 62*c,d*, and 62*e,f* arranged to respectively connect the coils 32, 34, 36 in parallel during the manual tripping operation. Specifically, each of the contact sets of the selector switch 56 is moved from the automatic operation position that connects the common trip and close supply 22 to the respective trip coils 32, 34, 36 into the manual trip and lockout position as shown in FIG. 1 wherein the trip coils 32, 34 and 36 are connected in parallel.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

The invention claimed is:

1. A manual trip control arrangement for a plurality of circuit interrupters each having a magnetic actuator circuit including a trip coil and a plunger, the manual trip control arrangement comprising:

first means for moving the plunger of a first of the magnetic actuator circuits in an opening direction a sufficient amount to initiate opening of the circuit interrupter; and second means responsive to said first means for disconnecting the magnetic actuator circuits and connecting the trip coils of the plurality of circuit interrupters in parallel with each other.

2. The manual trip control arrangement of claim 1 wherein the circuit interrupters have a manual trip control, said first means including means responsive to the manual trip control.

3. The manual trip control arrangement of claim 2 wherein said second means is responsive to the manual trip control.

* * * * *